US008132856B2

(12) United States Patent
Wilson et al.

(10) Patent No.: US 8,132,856 B2
(45) Date of Patent: Mar. 13, 2012

(54) SEATING FURNITURE WITH MEDIA STORAGE

(76) Inventors: Edward Earl Wilson, Sharpsburg, GA (US); Patrick Priest, Athens, TN (US)

( * ) Notice: Subject to any disclaimer, the term of this patent is extended or adjusted under 35 U.S.C. 154(b) by 0 days.

(21) Appl. No.: 12/460,375

(22) Filed: Jul. 17, 2009

(65) Prior Publication Data

US 2011/0012403 A1 Jan. 20, 2011

(51) Int. Cl.
*A47C 7/62* (2006.01)

(52) U.S. Cl. ..... 297/188.11; 297/217.3; 297/188.01; 297/188.08; 297/188.09

(58) Field of Classification Search ..... 297/217.3, 297/188.01–188.11
See application file for complete search history.

(56) References Cited

U.S. PATENT DOCUMENTS 2,174,582 A * 10/1939 Hudon ..... 5/308
2,671,228 A * 3/1954 De Maria ..... 5/41
2,692,007 A * 10/1954 Christian ..... 297/188.08
3,745,596 A * 7/1973 Copeland ..... 5/308
4,074,919 A * 2/1978 Watts ..... 297/233
4,141,585 A * 2/1979 Blackman ..... 297/180.14
4,321,717 A * 3/1982 Serra ..... 5/26.1
5,505,436 A * 4/1996 Roick ..... 267/107
5,520,436 A * 5/1996 Rader et al. ..... 297/188.11
6,074,000 A * 6/2000 Wagner ..... 297/188.11
6,644,593 B2 * 11/2003 Lambiaso ..... 244/118.5
6,863,344 B2 * 3/2005 Smallhorn ..... 297/217.3
6,984,057 B1 * 1/2006 Rogers ..... 362/253
7,143,978 B2 * 12/2006 Smallhorn ..... 244/118.5
7,513,000 B2 * 4/2009 DeBraal et al. ..... 5/600
7,770,966 B2 * 8/2010 Johnson ..... 297/122
2003/0057749 A1 * 3/2003 Buono ..... 297/217.3
2004/0105744 A1 * 6/2004 Warner et al. ..... 414/522
2005/0062370 A1 * 3/2005 Miller ..... 312/208.1
2006/0191923 A1 * 8/2006 Yoshidome ..... 219/756
2007/0040483 A1 * 2/2007 Arkay-Leliever ..... 312/194
2007/0171316 A1 * 7/2007 Mathias et al. ..... 348/837
2008/0290767 A1 * 11/2008 Rimback et al. ..... 312/223.1
2009/0039705 A1 * 2/2009 Lyman et al. ..... 307/64
2009/0121523 A1 * 5/2009 Johnson ..... 297/140
2009/0152915 A1 * 6/2009 Krasna et al. ..... 297/217.3
2009/0278390 A1 * 11/2009 Carter ..... 297/217.4

* cited by examiner

*Primary Examiner* — Laurie Cranmer

(57) ABSTRACT

An article of furniture for storing and powering electronic equipment including a seating area, at least one slidable drawer located under the seating area, and a power source located within the drawer.

12 Claims, 7 Drawing Sheets

SEATING FURNITURE WITH MEDIA STORAGE

CROSS-REFERENCE TO RELATED APPLICATIONS

This application claims the benefit of U.S. Provisional Pat. Application Ser. No. 61/198,445 filed Nov. 6, 2008, which is hereby incorporated by reference.

BACKGROUND OF THE INVENTION

Keeping a neat appearance in a home can be a challenging task. This is particularly true with proliferation of electronic media equipment available. Laptop computers, cell phones, mp3 players, and personal digital assistants (PDAs) now compete for space with the usual various and numerous remote controls, books, magazines, DVDs and CDs. Additionally, many homes also have wireless Internet routers, broadband modems, and game consoles also competing for space, as well as power outlets. As such, keeping a living area free from clutter, wires and all the various power adaptors for each of the personal electronics is nearly impossible.

SUMMARY OF THE INVENTION

Therefore, it is an object of the present invention to provide an article of seating furniture that includes at least one drawer for storing and powering media equipment, such as audio/video components, portable audio/video devices, personal electronic devices, computing devices, or game consoles.

To attain the above object, according to an aspect of the invention, there is provided an article of furniture including a seating area, at least one slidable drawer located under the seating area, and a power source located within said drawer.

Preferably, the drawer includes an opening in a rearward wall of the drawer to permit passage of at least one wire.

The opening preferably comprises a circular hole and/or a U-shaped slot.

Preferably, the drawer further includes an angle cut in an upper rear portion of said drawer, and may also include an opening in a rearward wall of said drawer to permit passage of at least one wire.

The power source preferably includes a plurality of power outlets.

Preferably, the article of furniture further includes an opening in the seating area to permit the passage of at least one wire between the drawer and the seating area. The opening in the seating area is preferably closeable by a hook and loop fastener or a zipper.

Preferably, the drawer is openable from either a front surface of the article of furniture or a side surface of the article of furniture.

Preferably, when the article of furniture includes two drawers, the article of furniture further includes a support brace located between the two drawers.

The seating area preferably includes a suspension system to prevent interference with said drawer. The suspension system preferably includes no sag springs.

These and other exemplary features and advantages of the present invention will become clear from the following description with reference to the accompanying drawings.

BRIEF DESCRIPTION OF THE DRAWINGS

The foregoing and other exemplary purposes, aspects and advantages will be better understood from the following detailed description of an exemplary embodiment of the invention with reference to the drawings, in which.

DETAILED DESCRIPTION OF THE INVENTION

Figure 1:
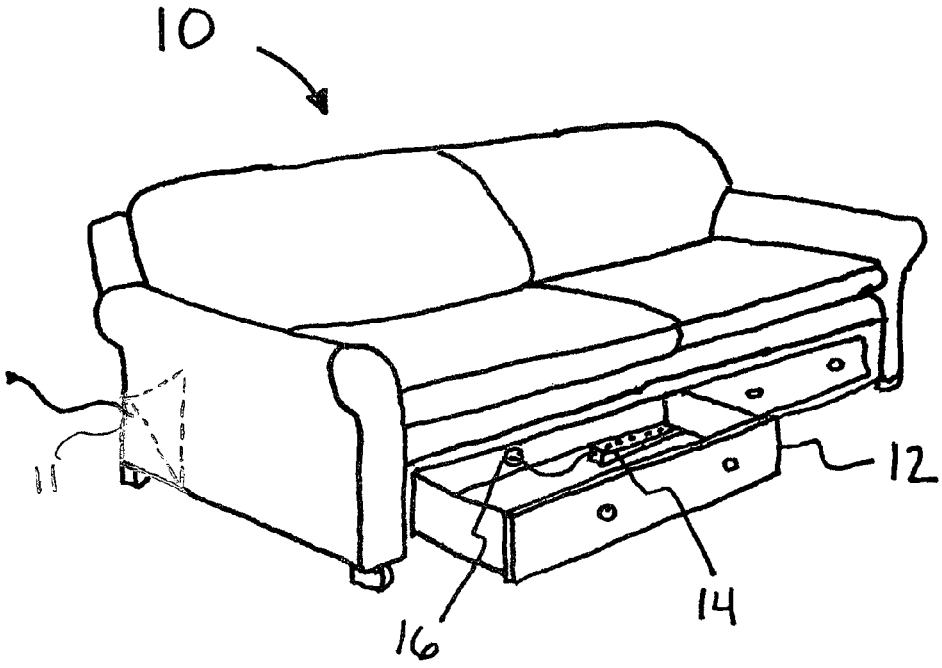
FIG. 1 shows a perspective view of an exemplary embodiment of the invention with a drawer in an opened position.

Referring now to the drawings, and more particularly to FIGS. 1-6, there are shown exemplary embodiments of the apparatus according to the present invention.

Figure 2:
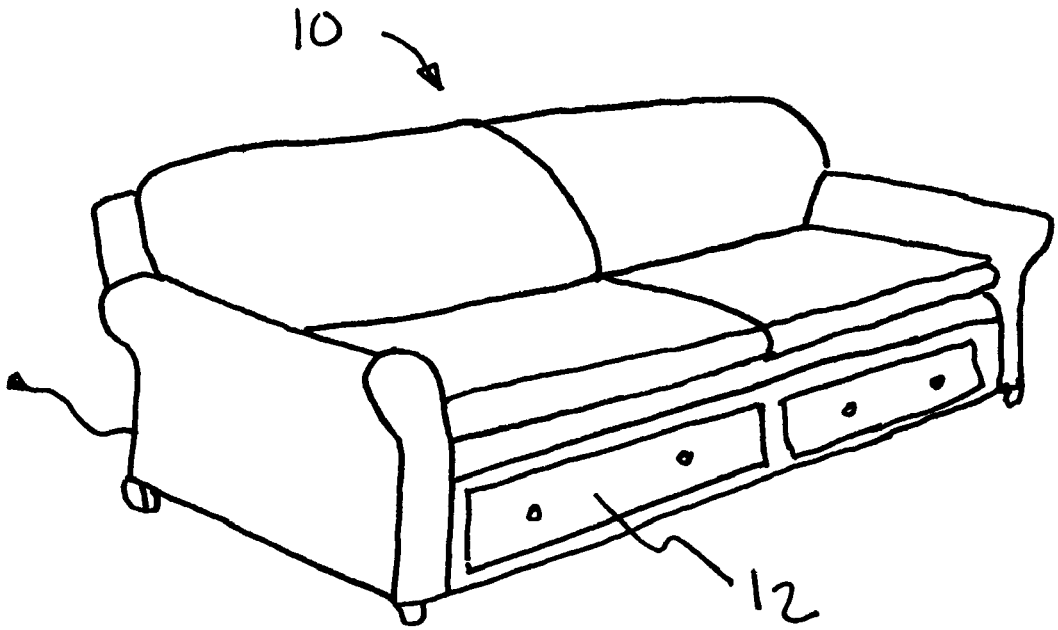
FIG. 2 shows a perspective view of the exemplary embodiment shown in FIG. 1 with the drawers in a closed position.

FIGS. 1-2 show an exemplary embodiment of the article of seating furniture 10 that includes at least one drawer 12 for storing and powering media equipment. The seating furniture may be any known type, such as a sofa, loveseat, chair, chaise lounge, divan, canapé, or ottoman. The media equipment may also be of any known type, such as audio/video components, portable audio/video devices, personal electronic devices, computing devices, communication devices, and/or game consoles. It should be understood that the media equipment may include any electronic device that may be plugged into a power outlet.

Figure 3:
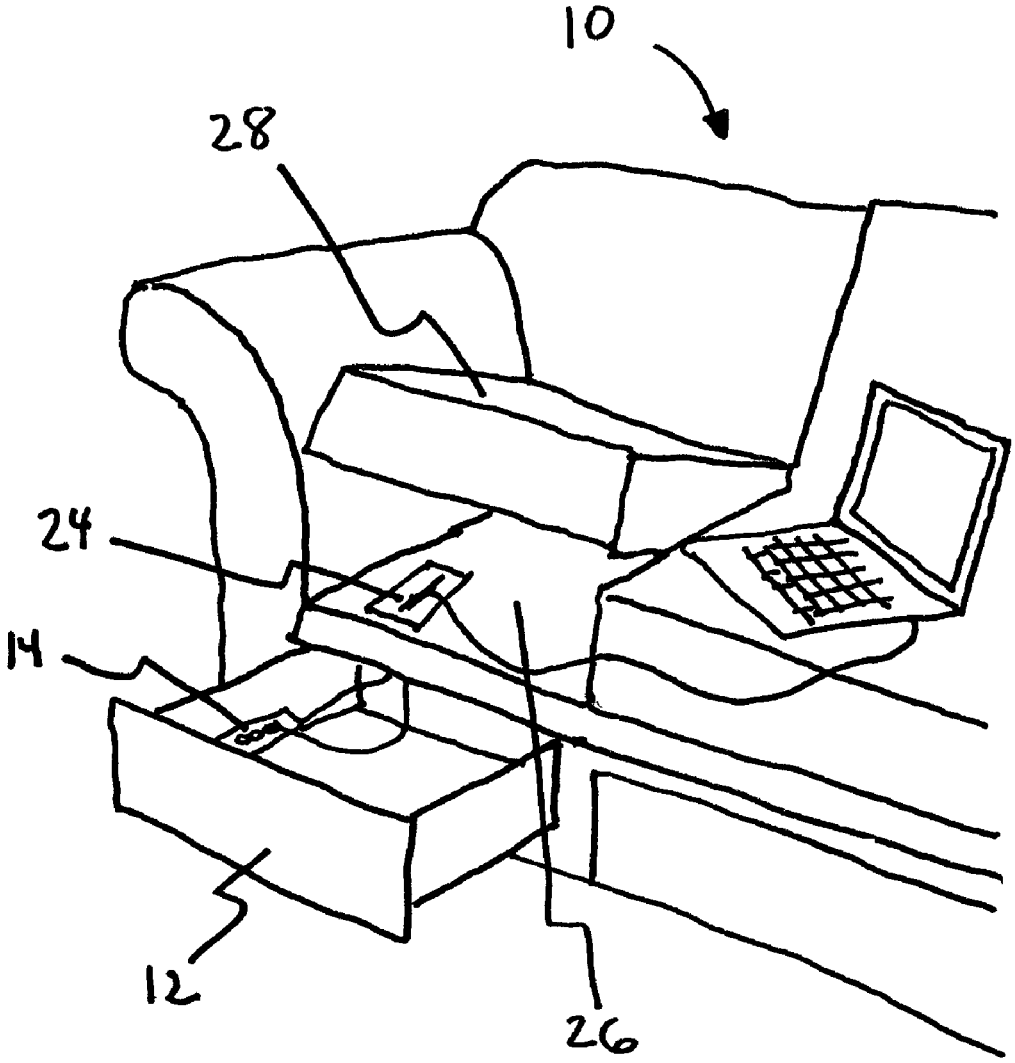
FIG. 3 shows a partial perspective view of another exemplary embodiment with a drawer in an open position.
Figure 4:
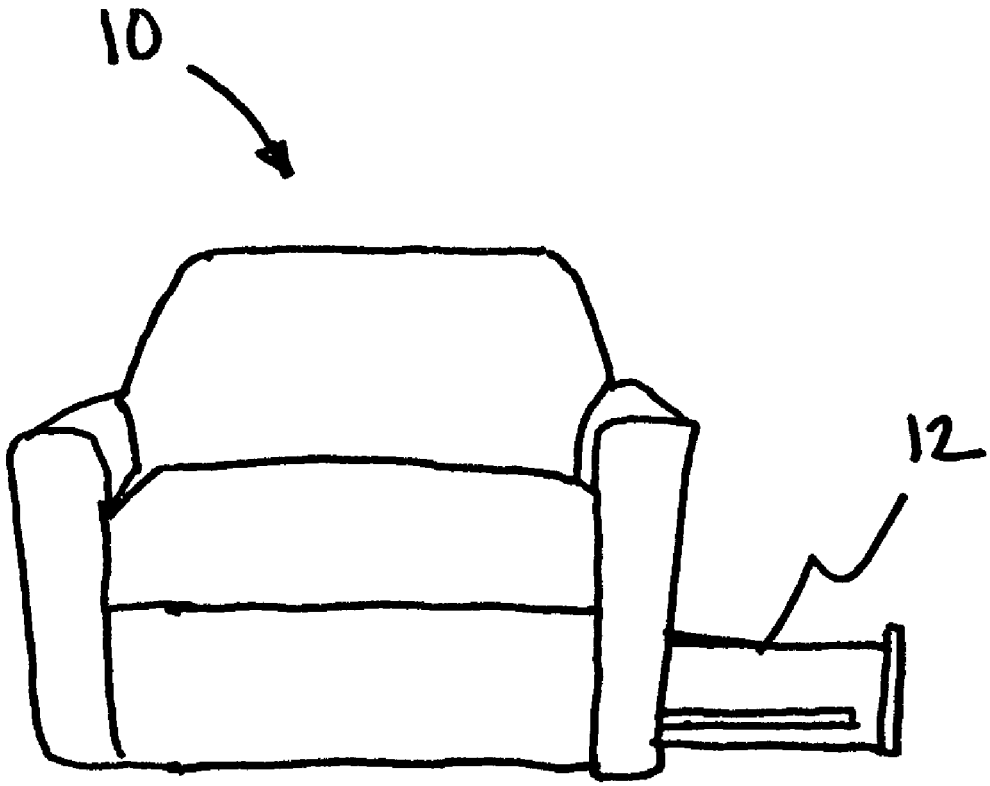
FIG. 4 shows a front view of the alternate embodiment of the invention with a drawer on a side surface.

As shown in FIGS. 1-3, the drawer 12 is preferably situated along the front surface of the furniture 10 beneath the seating area for easy access. However, it should be understood that the drawer may be located on any accessible side of the furniture 10 to suit the functional or aesthetic design of the furniture 10. For example, as shown in FIG. 4, the drawer 12 may be located on a side surface of the furniture 10.

The drawer 12 for media storage includes a power source 14 located within the drawer 12. The power source 14 preferably includes a plurality of power outlets in order to accommodate more than one item of media equipment. The power source 14 may be fully integrated into the drawer, fixedly attached to the inside of the drawer, or removable. Additionally, the power source 14 may be situated on any interior surface of the drawer 12.

Figure 5:
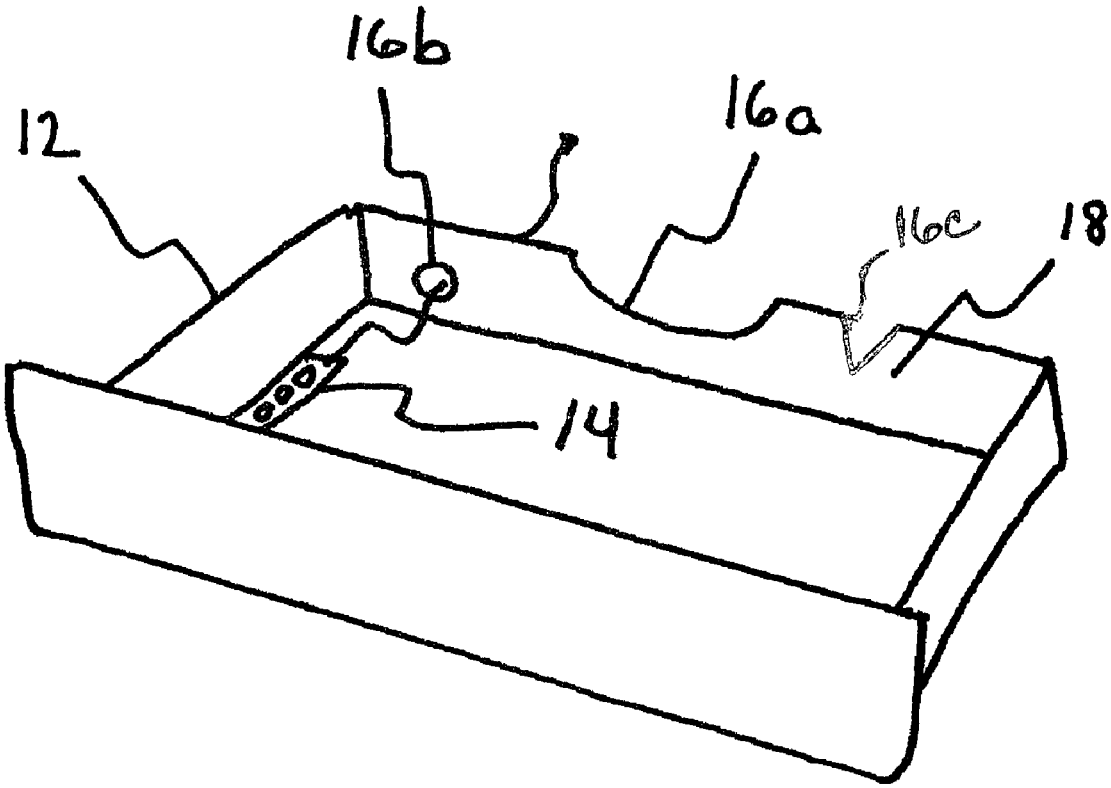
FIG. 5 shows a perspective view of a drawer.

The drawer 12 further includes an opening 16 on its rearward wall 18 to facilitate the passage of any wires or cables associated with the power source 14 and/or the media equipment stored in the drawer to the exterior of the furniture 12. For example, as shown in FIG. 5, the opening 16 may be a U-shaped slot 16*a* and/or a circular hole 16*b* and/or an angle cut 16*c* in the rearward or upper rearward wall 18 of the drawer 12. However, it should be understood that the opening 16 may be of any suitable shape or size that permits that passage of wires and/or cables associated with the power source 14 and/or media equipment.

Figure 6:
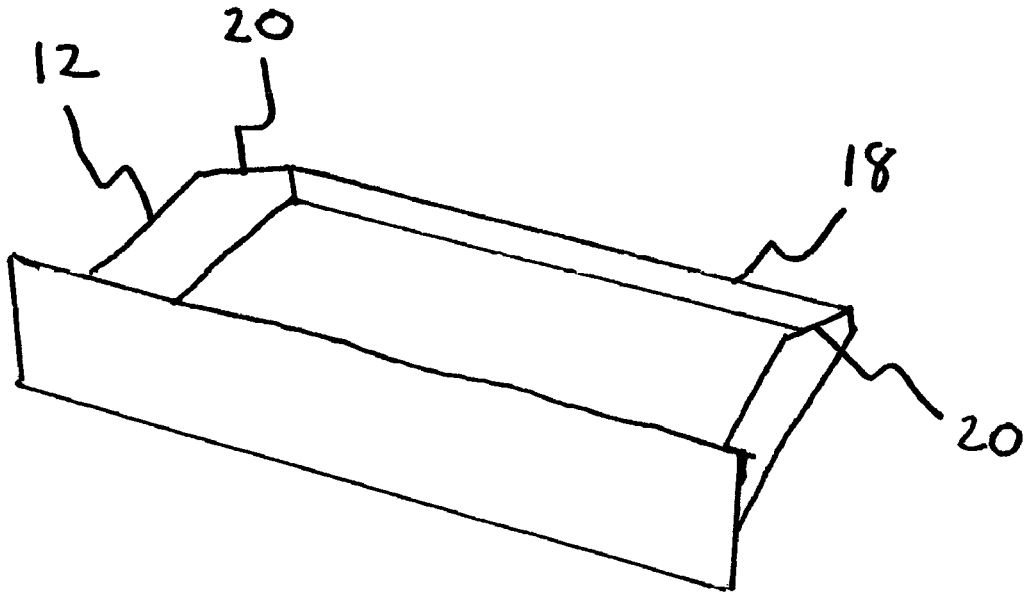
FIG. 6 shows a perspective view of an alternate drawer including an angle cut in the rear portion.

Alternately, as shown in FIG. 6, the drawer 12 may have an angle cut 20 in its rear portion, such that the rearward wall 18 is shorter than the front wall of the drawer 12 to permit passage of any wires or cables. Further, the angle cut 20 provides increased ventilation for the drawer 12 allowing any heat generated by electronic devices in the drawer 12 to escape. Additionally, the angle cut 20 in the drawer 12 helps prevent unwanted contact with drawer 12 by people when they sit on the article of furniture 10. It should be understood that the drawer may include a hole in the rearward wall 18 for passage of wires and cables, in addition to the angle cut 20.

As further shown in FIG. 1, the seating furniture 10 may also include an opening 11 through at least one of its exterior surfaces to facilitate passage of the wires and cables outside of the furniture. For example, such an opening 11 the seating furniture 10 may include a circular hole on its rear or any other surface for this purpose. However, as noted above, it should be understood that the opening may be of any suitable shape or size that permits that passage of wires and/or cables associated with the power source 14 and/or media equipment.

Preferably, any wires that pass from the drawer 12 to the exterior of the furniture 10 are fixedly attached to the frame of the furniture 10 with enough slack provided to any such wires to permit opening of the drawer 12. In this manner, tangling of wires may be prevented.

The visible front of the drawer 12 may be of any suitable design to comport with the design of the article of furniture 10. Alternatively, the front panel of the drawer may be louvered to improve the circulation of air to cool any media equipment that may be located within the drawer 12.

Preferably, as shown in FIG. 3, the furniture 12 further includes an opening 24 on the seating surface 26 beneath the cushions 28 to allow passage of a wire or wires from the drawer 12 to the seating area of the furniture 10 in order to permit users to simultaneously use and power their electronic devices while seated on the furniture 10. Preferably, the opening 24 comprises a slit that is closeable, for example, by a hook and loop fastener or zipper.

Preferably, when the furniture 10 includes multiple drawers 12, the furniture 10 includes a support brace running between the drawers 12. The support brace provides support for the rails of the drawer 12, as well as additional support for users sitting on the furniture 12 to prevent contact and interference with the drawers 12.

Figure 7:
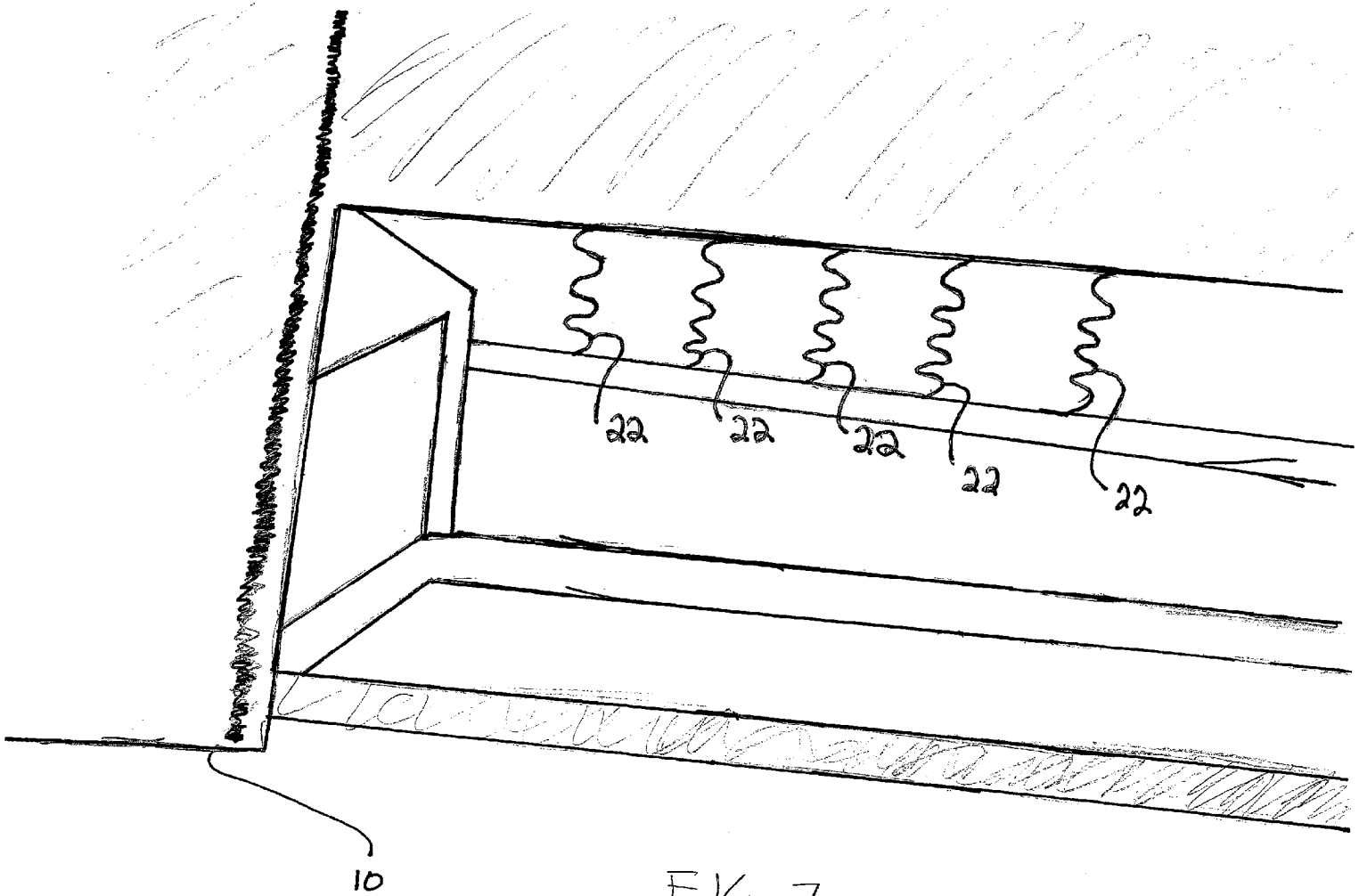
FIG. 7 shows a perspective view of the suspension system.

Preferably, as shown in FIG. 7, the furniture 10 also includes a suspension system to provide additional comfort to users, while preventing contact and interference with the drawer beneath the seating area when a user is seated. Preferably, the suspension system incorporates no sag springs 22, as opposed to coil springs that may protrude and interfere with the operation of the drawer.

While the invention has been described in terms of storing and powering electronic media equipment, it should be understood that the drawers 12 may be used to store any other items whether powered or not, such as remote controls, DVDs, CDs, books, magazines, blankets, etc.

While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. An article of seating furniture for storing and powering electronic equipment comprising:

a seating area;

at least one slidable drawer located under said seating area;

at least one power source including at least one power outlet located within said drawer; and a closeable opening in said seating area to permit the passage of at least one wire between said drawer and said seating area.

2. The article of furniture of claim 1, wherein said drawer further comprises an opening in a rearward wall of said drawer to permit passage of at least one wire.

3. The article of furniture of claim 2, wherein said opening comprises a circular hole.

4. The article of furniture of claim 2, wherein said opening comprises a U-shaped slot.

5. The article of furniture of claim 1, wherein said drawer further comprises an angle cut in an upper rear portion of said drawer.

6. The article of furniture of claim 5, wherein said drawer further comprises an opening in a rearward wall of said drawer to permit passage of at least one wire.

7. The article of furniture of claim 1, wherein said drawer is openable from a front surface of the article of furniture.

8. The article of furniture of claim 1, wherein said drawer is openable from a side surface of the article of furniture.

9. The article of furniture of claim 1, wherein said at least one drawer comprises two drawers.

10. The article of furniture of claim 9, further comprising a support brace located between said two drawers.

11. The article of furniture of claim 1, wherein said seating area comprises a suspension system to prevent interference with said drawer.

12. The article of furniture of claim 11, wherein said suspension system comprises no sag springs.

* * * * *